US007451861B2

(12) United States Patent
Bhavnani

(10) Patent No.: US 7,451,861 B2
(45) Date of Patent: Nov. 18, 2008

(54) COLLAPSIBLE UTILITY BAG AND ADVERTISING VEHICLE

(75) Inventor: Dilip Bhavnani, Beverly Hills, CA (US)

(73) Assignee: Sun Coast Merchandise Corporation, Commerce, CA (US)

( * ) Notice: Subject to any disclaimer, the term of this patent is extended or adjusted under 35 U.S.C. 154(b) by 247 days.

(21) Appl. No.: 10/821,098

(22) Filed: Apr. 7, 2004

(65) Prior Publication Data

US 2005/0224304 A1 Oct. 13, 2005

(51) Int. Cl.

| | |
|---|---|
| ***A45C 7/00*** | (2006.01) |
| ***A45C 13/02*** | (2006.01) |
| ***A45C 13/04*** | (2006.01) |
| ***A45C 13/36*** | (2006.01) |

(52) U.S. Cl. ..... 190/107; 190/110; 190/127; 150/113; 220/529; 206/315.1

(58) Field of Classification Search ..... 190/107, 190/110, 24, 103–105, 127, 901; 383/2, 383/38; 206/315.1; 150/113; 220/529, 530, 220/554

See application file for complete search history.

(56) References Cited

U.S. PATENT DOCUMENTS

| | | | | |
|---|---|---|---|---|
| 4,210,230 | A * | 7/1980 | Weiner | 190/107 |
| 4,655,329 | A | 4/1987 | Kaneko | |
| 4,752,008 | A | 6/1988 | Pratt | |
| 4,817,802 | A | 4/1989 | Pratt | |
| 4,895,230 | A | 1/1990 | King | |
| 4,951,818 | A * | 8/1990 | Johnson | 206/315.1 |
| 4,984,662 | A | 1/1991 | Jacober | |
| 5,042,664 | A | 8/1991 | Shyr | |
| 5,086,888 | A | 2/1992 | Chu | |
| 5,090,526 | A | 2/1992 | Jacober | |
| D325,675 | S | 4/1992 | Lui-Tan | |
| 5,222,642 | A * | 6/1993 | Solarz | 224/191 |
| RE34,361 | E | 8/1993 | Pratt | |
| 5,749,446 | A * | 5/1998 | Hsieh | 190/107 |
| 6,021,874 | A * | 2/2000 | Nykoluk | 190/103 |
| 6,129,254 | A * | 10/2000 | Yu | 224/575 |
| 6,132,059 | A * | 10/2000 | Leibowitz | 362/156 |
| 6,151,818 | A * | 11/2000 | Sadow | 40/529 |

(Continued)

FOREIGN PATENT DOCUMENTS

| | | | |
|---|---|---|---|
| GB | 2184940 A | * | 7/1987 |
| GB | 2404333 A | * | 2/2005 |

*Primary Examiner*—Sue A Weaver
(74) *Attorney, Agent, or Firm*—The Soni Law Firm

(57) ABSTRACT

The present invention relates to a collapsible utility bag which may, for example, be sized to fit within an athletic locker. The utility bag is generally rectangular in shape with a door that is hingedly attached to the front of the utility bag. Top and bottom rigid panels are provided, which are hinged or removable, and when in position support a top wall and a bottom wall. Removable side panels provide rigidity to side walls. Generally rectangular frames may be incorporated into the utility bag to provide further rigid support to the front and the rear of the bag. The utility bag can be collapsed for easy storage or shipping by removing the side panels, detaching the top and bottom panels, and collapsing the front of the bag towards the rear of the bag. A method for utilizing the present invention as a vehicle for advertising is also described.

13 Claims, 4 Drawing Sheets

U.S. PATENT DOCUMENTS

| | | | | |
|---|---|---|---|---|
| 6,231,233 | B1 * | 5/2001 | Orce | 383/38 |
| 6,244,399 | B1 * | 6/2001 | Birkestrand | 190/103 |
| 6,595,358 | B1 * | 7/2003 | Speck | 206/315.9 |
| 2002/0084159 | A1 * | 7/2002 | Hamlin | 190/107 |
| 2002/0125090 | A1 * | 9/2002 | Mercado et al. | 190/107 |
| 2004/0003975 | A1 * | 1/2004 | Dulin | 190/110 |
| 2004/0026280 | A1 * | 2/2004 | Herold | 206/315.3 |
| 2005/0051404 | A1 * | 3/2005 | Chi | 190/107 |

* cited by examiner

COLLAPSIBLE UTILITY BAG AND ADVERTISING VEHICLE

BACKGROUND OF THE INVENTION

1. Field of the Invention

The present invention relates to collapsible luggage. More specifically, the present invention relates to a collapsible utility bag capable of fitting in a gym locker or under an airplane seat. The present invention further includes a shelf or divider.

2. Description of the Prior Art (Point Out Disadvantages of Prior Art)

Bags and suitcases are available in a variety of sizes and shapes. Bags sized to fit in a gym locker or under an airplane seat are well known in the art. Also described in the prior art are various methods to make a suitcase collapsible for convenient and less expensive shipping, or storage in less space. Various luggage or bags with dividers or shelves are also well known.

Collapsible luggage is disclosed in U.S. Pat. No. 4,655,329 to Kaneko. This conventionally collapsible luggage has a pocket on the lower part of each side walls. The pocket accepts the lower end of a removable hard side reinforcing insert. The upper ends of the removable side reinforcing inserts are fixed to the upper part of the side walls by other fastening means, for example hook and loop fasteners. There is a hard bottom board and a ceiling board. The soft sides and front and rear faces may be folded up for storage when the hard side reinforcing inserts are removed. The disadvantage of Kaneko's invention, with a single side pocket design, is that the hook and loop fastener can become easily dislodged. The luggage would then unexpectedly collapse during use.

U.S. Pat. No. 4,752,008 (reissued as Re. 34,361) and U.S. Pat. No. 4,817,802 (a continuation in part of the preceding referenced '008 patent) to Pratt describe a utility bag sized to fit into an athletic locker or under the seat of an airplane. The bag has transversely positioned generally rectangular rigid frame members that are fixed in position. A fabric door is attached along a vertical side wall edge. A folding generally rigid divider panel is provided. Neither the bag nor the bag frame are collapsible. Furthermore, the attachment of the door along a vertical side wall edge is disadvantages. When the bag is located towards the rear of a gym locker, it is difficult to fully open the fabric door for full access to the interior of the bag. Also, fully opening the fabric door will block access to a neighboring side locker.

U.S. Pat. No. 5,042,664 to Shyr describes a collapsible utility bag with a hinged door and a plurality of shelves. The intermediary shelves are removable and are supported by a flexible suspension structure. A rigid bottom shelf is disposed along the bottom wall of the bag, permanently attached at the rearward frame member by a hinge attachment and reversibly attached to the forward frame member. To collapse the bag, the bottom shelf is rotated upwardly along the hinge attachment. The flexible side walls are supported by a pair of opposed, generally rectangular rigid frame members. The attachment of the bottom shelf at the opposed frame members imparts the rigidity to the bag. The disadvantage of these frame members is that they must either be thick and therefore heavy and bulky, or if thin, are predisposed to bending or breakage.

U.S. Pat. No. 5,090,526 (a continuation of U.S. Pat. No. 4,984,662) to Jacober discloses a self supporting, selectively collapsible soft walled carrier. The carrier is made of a plurality of pliable panels. The panel construction is described as an inner and an outer web layer having overlying peripheral edges and a resilient foam sheet layer intermediate the inner and outer layers. A foam sheet of between ¼ inch to 1¼ inches is described. The resilient pliable top and bottom panels include an intermediate fold line which permits each of these panels to be folded inwardly, permitting the sidewalls of the carrier to be brought together into a collapsed condition. A removable resilient pliable end panel insert is further provided for additional support. The other panels are not removable. A shelf member is also described. There are several disadvantages to this design. When collapsed, the folded top and bottom panels, combined with the side panels, result in a thickness of foam of at least one inch, up to five inches. Furthermore, pliable foam panels are not very rigid, and repeated folding of the top and bottom panels in likely to result in premature wear of this bag.

SUMMARY OF THE INVENTION

It is an object of the present invention to provide for a collapsible utility bag that will fit in an athletic locker or under a commercial airplane seat.

Another object of the present invention is to provide for a collapsible utility bag that is rigid when assembled, durable, and unlikely to collapse unexpectedly.

Still another object of this invention is to provide for a collapsible utility bag that has a conveniently hinged opening panel and provides for attachment of at least one shelf or divider.

It is yet another object of the present invention to provide for a collapsible utility bag that folds to a very small size for economical shipping and convenient storage when not in use.

The objects of this invention are accomplished by a soft sided utility bag with removable inserts. There are two side walls, a bottom wall, and a top wall delineating a front rectangular opening and a rear rectangular opening. The rear rectangular opening is supported by a generally rectangular rigid frame, for example of wire, and is sealed by a rear wall. Hingedly attached to the front rectangular opening is a door. The door has a generally rectangular rigid frame, for example of wire, that matches the frame on the rear rectangular opening. In the preferred embodiment, the door is hingedly attached to the front edge of the bottom wall. A zipper closure is provided to join the door to the front rectangular opening. The inner side of the door may further contain storage compartments. In the preferred embodiment, the side walls each have an upper pocket and a lower pocket. A rigid side panel removably inserts between the upper pocket and corresponding lower pocket on each side, thus providing rigid support to the side walls. A rigid bottom panel is hingedly attached to the rear edge of the bottom wall and is capable of being fastened to the front portion of the bottom wall by fastening means, for example hook and loop fasteners. A rigid top panel is hingedly attached to the rear edge of the top wall and is capable of being fastened to the front portion of the top wall by fastening means, for example hook and loop fasteners. Web like straps may detachably attach to the rigid side panels and are capable of supporting a rigid detachable shelf. The utility bag is collapsed by removing the shelf, removing the rigid side panels from the side wall pockets, detaching the front of the bottom panel and folding it against the rear wall, detaching the front of the top panel and folding it against the rear wall, and then moving the door and front rectangular opening towards the real wall.

In at least one other embodiment, instead of an upper pocket and lower pocket on each side, the rigid side panels insert into a zippered compartment.

The method of collapsing the utility bag comprises removing the side panels from each of the upper pockets and lower pockets of the side walls, pivoting the bottom panel and the top panel towards each other to abut the rear wall, and then moving the front rectangular opening towards the rear wall to collapse the utility bag.

The advantage of the present invention is that the utility bag of the present invention is collapsible to a very thin space for shipping or storage. The bag may be quickly assembled into a rigid form. The semirigid side panels are very securely held in place by the side wall pockets and will ensure that the bag will not unexpectedly collapse. The front and rear generally rectangular rigid frames are very thin, and yet provide excellent support when combined with the rigid side panels. By hinging the door to the bottom of the front rectangular opening, the bag may be fully opened without interfering with neighboring lockers on either side.

Another advantage of the utility bag of the present invention is that it may be used as an advertising vehicle. The bag, with advertising imprinted upon it, may be distributed in expanded form to attendees of a convention. The bag may be filled at the convention with various brochures, literature, and samples. The bag may then be collapsed and conveniently placed within other luggage for the trip home.

The preferred embodiment of the utility bag of the present invention comprises two side walls connected with a top wall and a bottom wall to form a generally rectangular cavity with a generally rectangular front opening and a generally rectangular rear opening; a rear wall connected with said generally rectangular rear opening; a door hingedly connected with an edge of said generally rectangular front opening; a rigid bottom panel hingedly connected with an edge of said bottom wall; a rigid top panel hingedly connected with an edge of said top wall; removable side panels capable of being removably retained against each of said side walls; means for removably retaining each of said side panels to each of said side walls; and; a zipper closure connected with said door, and further connected with the front rectangular opening, wherein the periphery of said door may be closed to the periphery of said front rectangular opening.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as exhaustive or restrictive.

BRIEF DESCRIPTION OF THE DRAWINGS

The accompanying Figures depict embodiments of the present invention, and features and components thereof. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding, sewing, and machining may be used.

Any references to front and back, right and left, top and bottom, superior and inferior, upper and lower, inner and outer, medial and lateral, and horizontal and vertical are intended for convenience of description, not to limit the present invention or its components to any one positional or spacial orientation.

Figure 1:
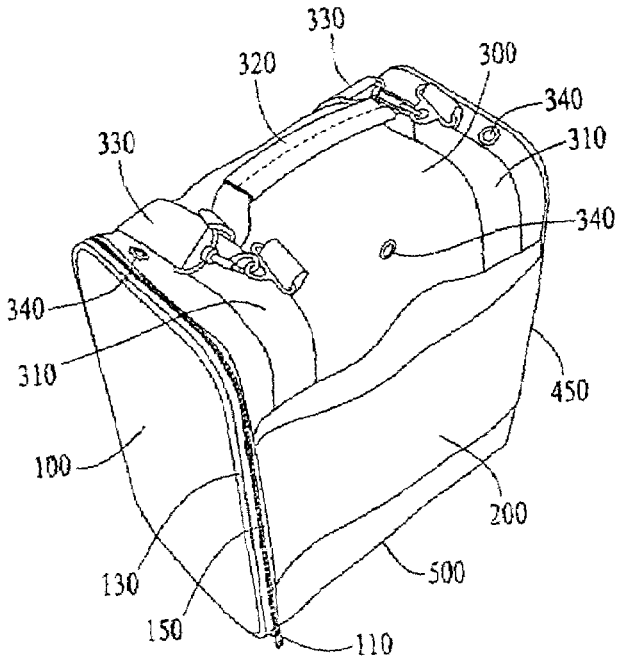
Figure 2:
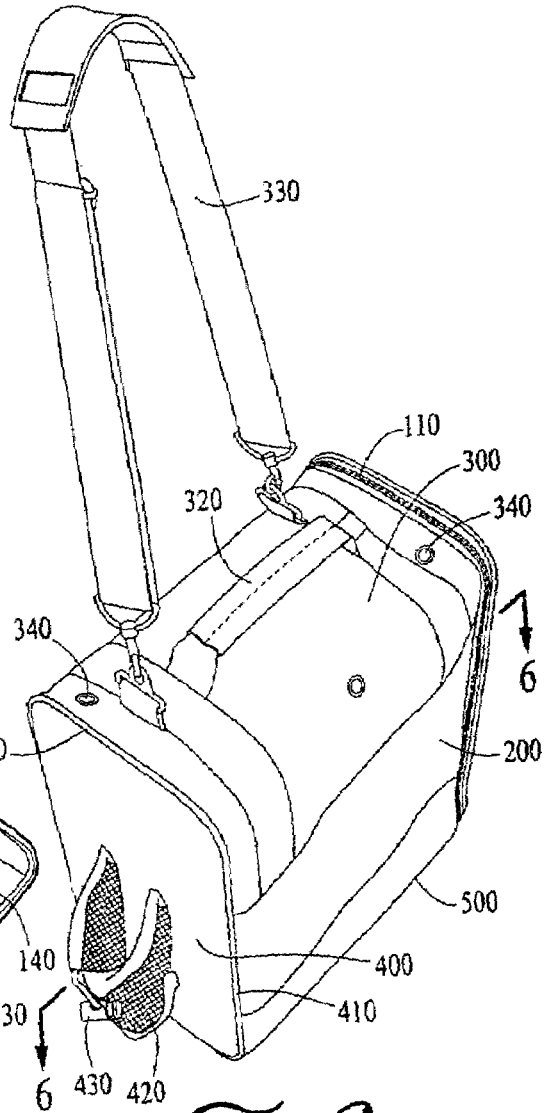
Figure 3:
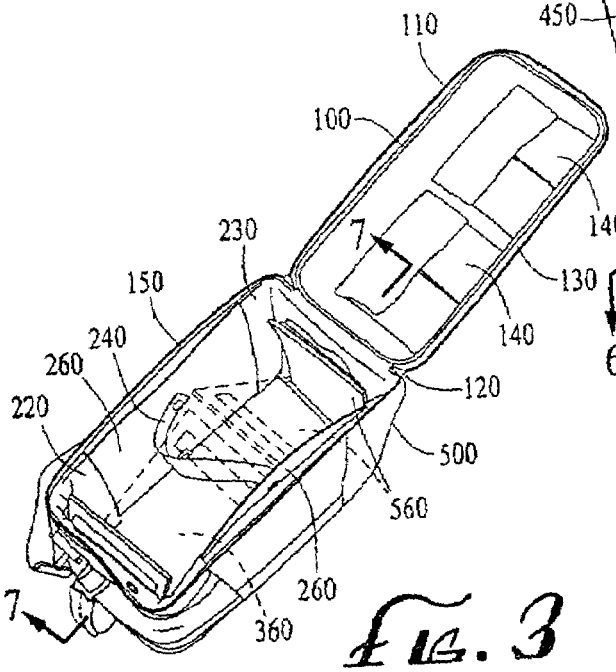
Figure 4:
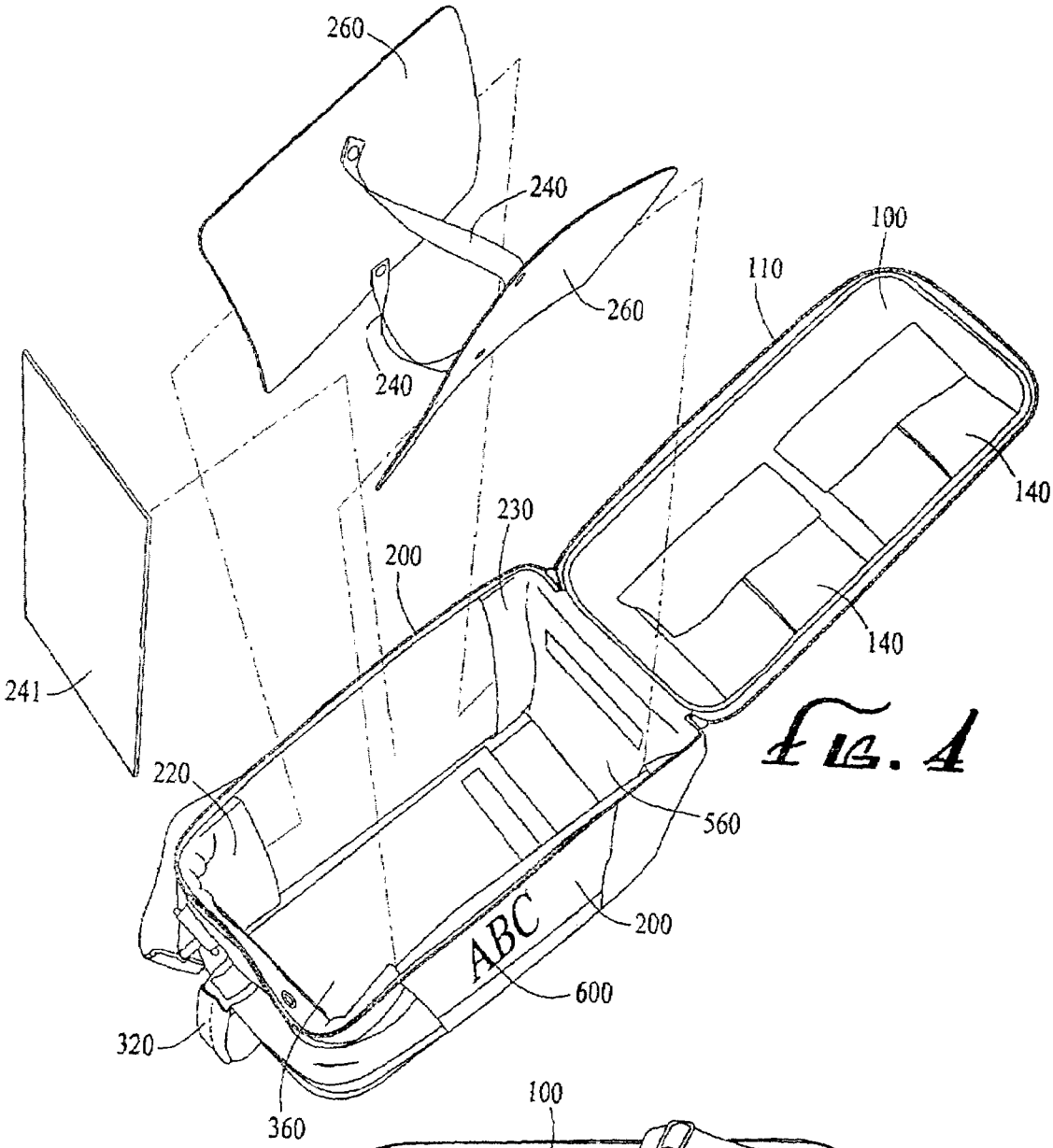
Figure 5:
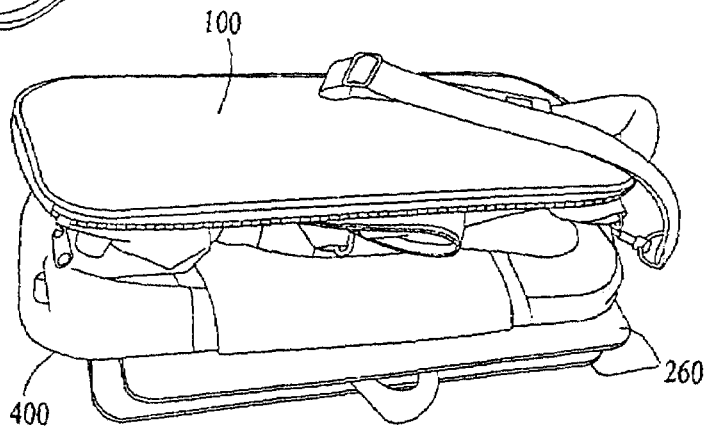
Figure 6:
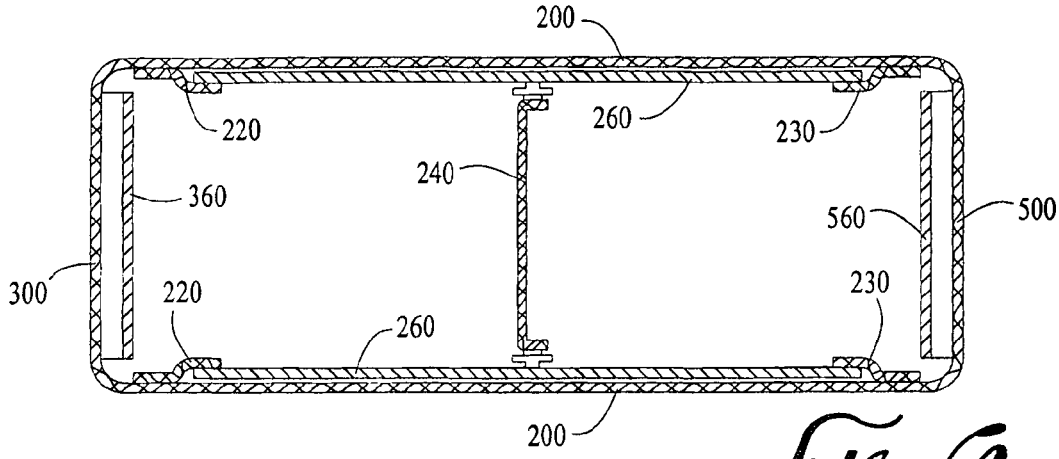
Figure 7:
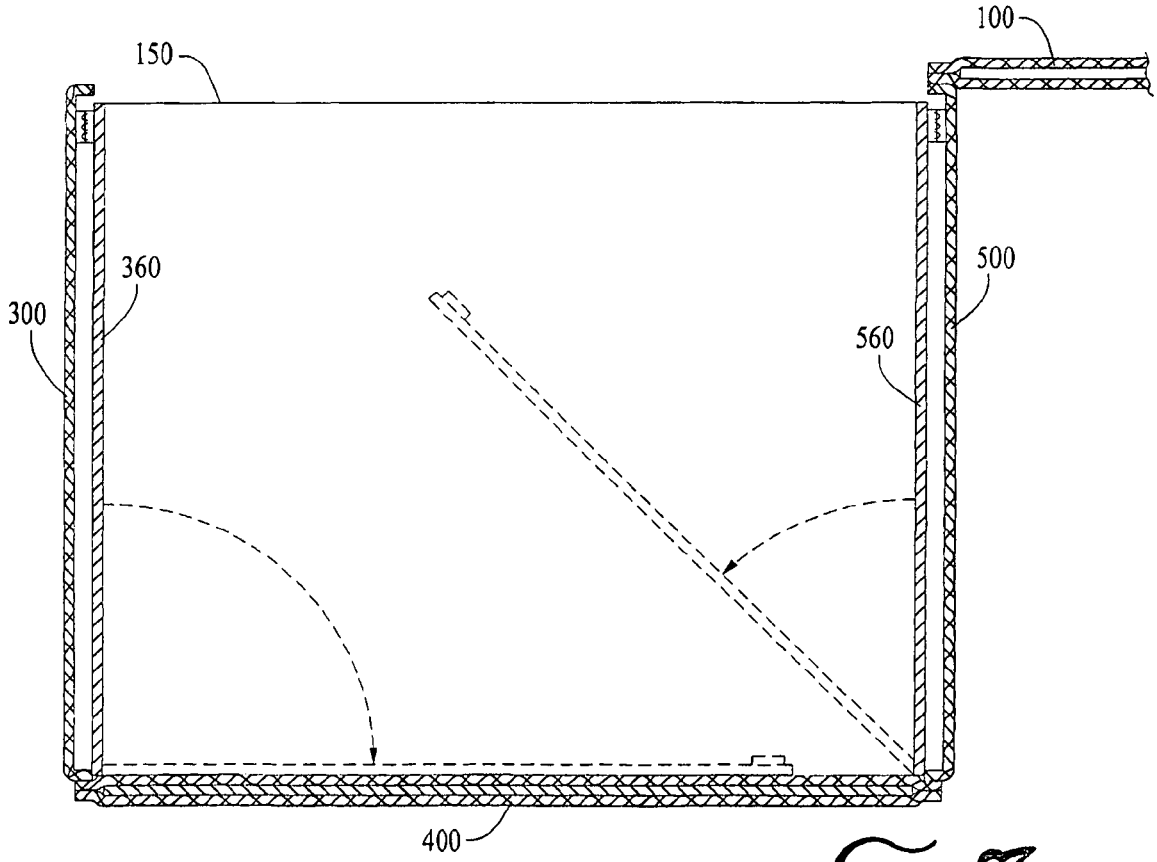

The foregoing objects, features, advantages and preferred embodiments of the present invention will be better understood from the following detailed description taken in conjunction with the accompanying drawings in which:

FIG. 1 is a front right side perspective view of an embodiment of the present invention showing the assembled utility bag;

FIG. 2 is a rear left side perspective view of an embodiment of the present invention illustrating the assembled utility bag with strap attached;

FIG. 3 is a front side view of an embodiment of the present invention illustrating the interior of the utility bag with top panels and bottom panels folding down towards the rear wall;

FIG. 4 is a front side view of an embodiment of the present invention illustrating how the side panels are removed from pockets in the side walls;

FIG. 5 is a side view of an embodiment of the present invention illustrating the collapsed bag;

FIG. 6 is a front cross sectional view through the present invention illustrating an assembled utility bag with top panel, bottom panel, side panels, and shelf in assembled positions; and;

FIG. 7 is a side cross section view through the present invention illustrating how the top panel and bottom panel fold down towards the rear wall and further showing the attachment of the door to the bottom wall.

Figure 8:
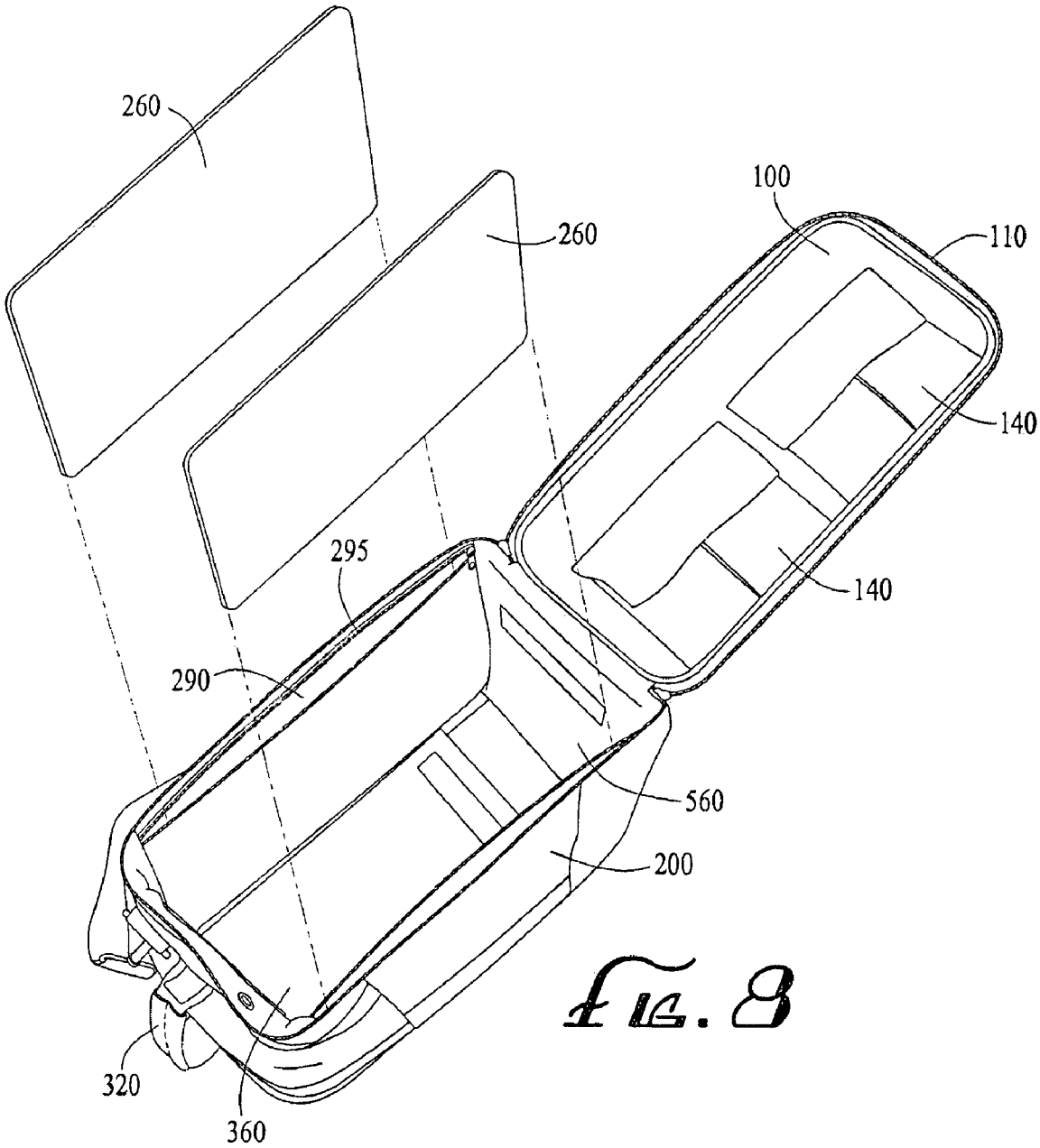

FIG. 8 is an illustration of an alternative embodiment, showing how the rigid side panels may be held against the side walls by insertion into a zippered compartment.

DETAILED DESCRIPTION OF THE PREFERRED EMBODIMENTS

Referring more specifically to the drawings, there is illustrated in FIG. 1 an embodiment of the utility bag of the present invention illustrating a door 100 with a zippered closure 110, a side wall 200, and a top wall 300. The walls of the utility bag are preferably made of a synthetic or natural fabric, for example of nylon, polyester, or cotton. There is a webbing reinforcement 310 attached to the top wall 300 and the side walls 200 where, additionally, a handle 320 and a carrying strap 330 may be attached. A plurality of ventilation holes 340 may be further provided in the walls for ventilation of the contents of the bag.

Referring now to FIG. 2, a rear wall 400 and the other side wall 200 are illustrated. The side walls 200, top wall 300, and a bottom wall 500 are connected together to define a generally rectangular cavity with a generally rectangular front opening 150 and a generally rectangular rear opening 450. The generally rectangular rear opening 450 is supported by a generally rectangular rigid frame 410, for example a wire frame, enclosed in a fabric or plastic covering. The generally rectangular rear opening 450 is sealed by the rear wall 400. In this embodiment, a pouch 420 comprising net like material may be provided on the outside of the rear wall 400 of the utility bag for further storage space. The pouch 420 is further provided with a drawstring 430 to close the top of the pouch 420. The carrying strap 330 and handle 320 are again illustrated.

Referring now to FIG. 3, the interior of the utility bag of the present invention is visualized through the generally rectangular front opening 150. The door 100 is hingedly attached to one front edge 120 of the generally rectangular front opening 150. The door is preferably hingedly attached to the bottom wall 500. An advantage of hingedly attaching the door 100 to the bottom wall 500 is that the door 100 may be fully opened without impinging on side adjacent athletic lockers in a locker room. However, in other embodiments, the door may alternatively be hingedly attached to one of the side walls 200 or to the top wall 300. The door 100 has a peripheral generally rectangular rigid frame 130, for example a wire frame, that is enclosed in a fabric or plastic covering. In alternative embodiments, the front generally rectangular rigid frame 130 may be incorporated into the periphery of the generally rectangular front opening 150. The inner side of the door 100 may further contain one or more storage compartments 140. There is a zippered closure 110 connected with the door 110 and the generally rectangular front opening 150. When the zipper closure 110 is closed, the door 100 joins to the generally rectangular front opening 150, wherein the utility bag is closed shut.

The present invention further comprises at least one rigid bottom panel 560 that is capable of providing support to the bottom wall 500, and at least one rigid top panel 360 that is capable of providing support to the top wall 300. The rigid bottom panel 560 is preferably hingedly attached to a rear edge of the bottom wall 500 and is capable of being fastened to a front portion of the bottom wall 500 by fastening means, for example hook and loop fasteners. The rigid top panel 360 is hingedly attached to a rear edge of the top wall 300 and is capable of being fastened to a front portion of the top wall 300 by fastening means, for example hook and loop fasteners. When the bag is collapsed, the bottom panel 560 and the top panel 360 are pivoted to a position where they lay flat against each other and the rear panel 400. Alternatively, the top panel 360 and the bottom panel 560 may be completely removable and capable of detachable fastening to the top wall 300 and bottom wall 500 respectively. Fastening means could include, for example, hook and loop fasteners or retaining pockets.

Referring now to also to FIG. 4, each side of the utility bag has a means for retaining a side panel 260 against the interior surface of a side wall 200. In the preferred embodiment, the side panel retaining means is an upper pocket 220 and a lower pocket 230. Bilaterally symmetrical rigid or semirigid side panels 260 are removably retained between the upper pocket 220 and corresponding lower pocket 230 on each side, thus providing rigid support to the side walls 200 when the side panels 260 are in place. In the preferred embodiment, the side panels 260 are just flexible enough to allow insertion into the pockets, while still providing rigid support to the side walls 200. The side panels 260 are removed from the upper pocket 220 and the lower pocket 230 when the user desires to collapse the utility bag. In the preferred embodiment, the side panels 260 are comprised of plastic, but other materials well known in the art may be substituted. Furthermore, one or more straps 240 may detachably attach, for example by snaps, to the interior surfaces of the rigid side panels 260. The straps 240 are capable of providing support for at least one removable shelf 241, as shown in FIG. 4, which may also be utilized to divide the interior of the utility bag into at least two sections.

As shown in FIG. 5, when the side panels 260 are removed, and the top panel 360 and bottom panel 560 are pivoted towards the rear wall 400, the generally rectangular front opening 150 is capable of moving towards the rear wall 400, and the utility bag collapses for storage or shipment. There are many advantages to a collapsible bag. By removing the dead space between the walls, a multitude of utility bags may be shipped within an economical cargo space. The utility bags can therefore be inexpensively distributed after manufacture. The collapsible utility bag of the present invention further appeals to a consumer because the bag takes up very little storage space when collapsed and not in use. Apartment dwellers with a shortage of storage space will appreciate this feature. Furthermore, a collapsed bag may easily be transported within other luggage. The utility bag of the present invention may therefore be taken on a vacation, and assembled only used, for example, when going to a gym. Alternatively, the collapsible utility bag may be filled with items purchased on vacation and provides for a convenient additional piece of luggage on the trip home.

Another advantage of the utility bag of the present invention is that it may be used as an advertising vehicle. The bag with advertising 600 imprinted upon it (as shown in FIG. 4), may be distributed in expanded form to attendees of a convention. The bag may be filled at the convention with various brochures, literature, and samples. The bag may then be collapsed and conveniently placed within other luggage for the trip home.

The method of expanding and collapsing the utility bag of the present invention will now be described in more detail. Referring to FIG. 6 and FIG. 7, the expanded utility bag comprises the two side walk 200, the top wall 300, and a bottom wall 500. Each side wall 200 is capable of being supported by insertion of a side panel 260 into and between an upper pocket 220 and a lower pocket 230. The top panel 360 provides support to the top wall 300, and the bottom panel 560 provides support to the bottom wall 500. A shelf 241 may be removably positioned on the straps 240 between the side panels 260, as shown in FIG. 4. In this preferred embodiment, the door 100 is hingedly attached to the front of the bottom wall 500. The method of expanding the utility bag, and rendering the utility bag rigid comprises joining and fastening, for example by hook and loop fasteners or snaps, the top panel 360 to the top wall 300, similarly joining and fastening the bottom panel 560 to the bottom wall 500, and inserting the side panels 260 into the side panel retaining means of each side wall 200. The method of collapsing the utility bag comprises removing the side panels 260 from each of the side panel retaining means of the side walls 200, pivoting the bottom panel 560 and the top panel 360 towards each other to abut the rear wall 400, and moving the front rectangular opening 150 towards the rear wall 400 to collapse the utility bag.

Referring now to FIG. 8, in at least one other embodiment, alternate means for retaining the side panels 260 against a side wall 200 may be utilized. For example, rather than the upper pockets 220 and the lower pockets 230, the utility bag may include a side compartment 290 proximate to the inner face of each side wall 200. The side compartment preferably includes a closure, for example, a zipper 295 along the front edge of the side compartment 290. Various other closures, for example, snaps or hook and loop fasteners may alternatively be utilized. A side panel 260 may be inserted into each side compartment 290. When the side compartment 290 is closed, the side panel 260 is retained within the side compartment 290, wherein the side panel 260 provides rigid support to the corresponding side wall 200. The semirigid or rigid side panels 260 may be removed from the side compartments 290, when it is desirable to collapse the utility bag. Alternative methods of retaining a side panel 260 to a side wall 200, for example, snaps or hook and loop fasteners, are well known in the art and may be substituted for the upper pockets 220 and lower pockets 230, or the side compartments 290.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A utility bag comprising:

a. two opposing side walls connected with a top wall and an opposing bottom wall to form a generally rectangular cavity with a generally rectangular front opening and a generally rectangular rear opening;

b. a rear wall connected with said generally rectangular rear opening;

c. a door hingedly connected with an edge of said generally rectangular front opening;

d. a rigid bottom panel connected with said bottom wall;

e. a rigid top panel connected with said top wall;

f. a side panel removably retained against each of said side walls in parallel relation therewith for providing support thereto;

g. at least two elongated straps extending between said side panels, each of said at least two straps being generally perpendicular to said side panels; and h. a shelf removably disposed between said side panels for dividing the generally rectangular cavity, said shelf being supported by said at least two straps extending between said side panels generally perpendicularly thereto.

2. The utility bag as in claim 1 further comprising:

a. a generally rectangular frame connected with said door; and b. a generally rectangular frame connected with said rear wall.

3. The utility bag as in claim 1 wherein each of said side panels is removably retained in an upper pocket and an opposing lower pocket formed on said respective side wall.

4. The utility bag as in claim 3, wherein said upper and lower pocket are positioned adjacent said top and bottom walls respectively.

5. The utility bag as in claim 3, wherein a substantial portion of each of said side panels is exposed for removably attaching opposing ends of said at least two straps thereto.

6. The utility bag as in claim 1 further including advertising indicia disposed upon an exterior surface thereof.

7. The utility bag as in claim 1, further comprising:

a. a generally rectangular frame connected with said generally rectangular front opening; and b. a generally rectangular frame connected with said generally rectangular rear opening.

8. The utility bag as in claim 1, wherein said at least two straps are configured to removably engage the side panels.

9. The utility bag as in claim 8, wherein said at least two straps are disposed parallel to each other.

10. The utility bag as in claim 1, wherein said top and bottom panels are configured to be disconnectible from said respective top and bottom walls for collapsing the utility bag.

11. The utility bag as in claim 1, wherein said top and bottom panels are hingedly connected to said respective top and bottom walls so as to be folded substantially flat upon said rear wall when collapsing the utility bag.

12. The utility bag as in claim 1, further comprising a handle attached to an exterior surface of said top wall.

13. A method of advertising comprising the steps of:

a. providing a collapsible utility bag, said utility bag including:

1. two opposing side walls connected with a top wall and an opposing bottom wall to form a generally rectangular cavity with a generally rectangular front opening and a generally rectangular rear opening;

2. a rear wall connected with said generally rectangular rear opening;

3. a door hingedly connected with an edge of said generally rectangular front opening;

4. a rigid bottom panel connected with said bottom wall;

5. a rigid top panel connected with said top wall;

6. a side panel removably retained against each of said side walls in parallel relation therewith for providing support thereto;

7. at least two elongated straps extending between said side panels, each of said at least two straps being generally perpendicular to said side panels; and 8. a shelf removably disposed between said side panels for dividing the generally rectangular cavity, said shelf being supported by said at least two straps extending between said side panels generally perpendicularly thereto; and b. disposing advertising material upon at least one outer surface of said utility bag.

* * * * *